US006006395A

United States Patent [19]

Tiramani et al.

[11] Patent Number: 6,006,395

[45] Date of Patent: Dec. 28, 1999

[54] CUSHION BRUSH

[75] Inventors: Paolo B. Tiramani, Greenwich; Soohyun Ham, Stamford; John A. Bozak, Greenwich, all of Conn.

[73] Assignee: 500 Group, Inc., Greenwich, Conn.

[21] Appl. No.: 08/585,660

[22] Filed: Jan. 12, 1996

[51] Int. Cl.[6] ..... A46B 7/02; A46B 9/02

[52] U.S. Cl. ..... 15/176.1; 15/176.5; 15/186; 15/201

[58] Field of Search ..... 15/172, 176.1, 15/176.4, 176.5, 176.6, 186, 187, 188, 201, 202; 119/615, 664; 132/126, 156, 163

[56] References Cited

U.S. PATENT DOCUMENTS

| | | | |
|---|---|---|---|
| 1,600,368 | 9/1926 | Skoglund . | |
| 1,999,846 | 4/1935 | Page . | |
| 2,443,297 | 6/1948 | Bressler . | |
| 2,706,825 | 4/1955 | Blakeman | 15/176.4 |
| 2,722,031 | 11/1955 | Bressler . | |
| 2,730,747 | 1/1956 | Bressler . | |
| 2,888,698 | 6/1959 | Kaye et al. . | |
| 2,963,729 | 12/1960 | Thonbo | 15/176.1 |
| 3,739,419 | 6/1973 | Natman et al. . | |
| 3,766,590 | 10/1973 | Wachtel | 15/186 |
| 3,886,619 | 6/1975 | Natman et al. . | |
| 4,423,531 | 1/1984 | Wall | 15/187 |
| 4,694,844 | 9/1987 | Berl et al. . | |
| 4,712,267 | 12/1987 | Cheng | 15/172 |
| 5,269,038 | 12/1993 | Bradley . | |
| 5,323,793 | 6/1994 | Lorenzi . | |
| 5,327,611 | 7/1994 | Balster | 15/187 |
| 5,335,390 | 8/1994 | Chen . | |
| 5,355,546 | 10/1994 | Scheier | 15/167.1 |
| 5,651,158 | 7/1997 | Halm | 15/172 |

FOREIGN PATENT DOCUMENTS

| | | | |
|---|---|---|---|
| 2042282 | 3/1972 | Germany | 15/186 |

*Primary Examiner*—Randall E. Chin
*Attorney, Agent, or Firm*—Foley & Lardner

[57] ABSTRACT

The present invention features a brush or hair grooming instrument that can be configured to orient bristles or teeth inwardly toward a contact region along generally parallel lines with relatively little contact force, thus expanding the effective area over which the instrument contacts the hair. According to a preferred aspect of the invention, the instrument comprises a rigid support having a longitudinal axis and a flexible membrane having first and second ends pivotally attached to the rigid support. The flexible membrane comprises a plurality of substantially rigid sections integrally joined along parallel lines of flexure, with the parallel lines of flexure disposed perpendicular to the longitudinal axis of the rigid support. The flexible membrane may be biased into a normal or relaxed configuration and transition into a flexed or bent shape through a more or less pronounced "snap" action. A plurality of combing elements are secured to and extend from the flexible membrane. The present invention can be easily adapted to various shapes and types of grooming instruments, including handled brushes of different head shapes, handled combs and palm-type brushes, as well as to a variety of brushing devices.

31 Claims, 5 Drawing Sheets

CUSHION BRUSH

BACKGROUND OF THE INVENTION

The present invention relates generally to a cushion hair brush. More particularly, the invention relates to a brush or comb having a cushion supported on a handle, in which the cushion is configured and supported to permit flexure during use such as to direct bristles supported on the cushion toward the user along parallel lines.

A great variety of hair grooming devices, such as combs and brushes have been proposed and are currently available. Conventional brushes typically include a head supporting an array of bristles extending from one face of the head, or partially or completely around the head. In recent years it has become very common to support the bristles on a flexible membrane or cushion that is convex in shape and is supported about its periphery by the brush head structure. To facilitate manufacturing, such bristle supports are sometimes configured as a separate, fairly rigid element that can be snapped or otherwise secured to the brush head during an assembly step.

The convexity of known brush cushions generally results in arrangement of the brush bristles in a similar convex pattern when the brush is not in use. Because the cushion membrane is fairly resilient, the membrane flexes as the bristles are brought into contact with the hair, thereby directing certain of the bristles toward the user. However, because known cushion brushes typically employ bristle support membranes of generally uniform thickness, the brush bristles become oriented or directed toward the point of contact with the hair, tending to concentrate the bristle tips in a small region around the point of contact. Moreover, membranes of many known cushion brushes require the brush to be pressed rather forcefully at the point of contact before deformation of the cushion actually takes place. Consequently, when less than the required deformation force is exerted by the user, the majority of the bristles remain in their convex arrangement, greatly reducing the number of bristles in contact with the hair and limiting the actual usefulness of the brush. Moreover, the convex shape of the bristle support membrane in conventional cushion brushes creates a structure which mechanically resists deflection, tending to further increase the force required for deflection of the bristles. Finally, because the membrane of conventional cushion brushes is typically tightly supported on the brush head, the membrane tends to undergo generally S-shaped deflection in the manner of a fixed-end beam, rather than even, uniform deflection.

There is a need, therefore, for an improved cushion-type brush that provides the desired degree and direction of flexure of the bristle support membrane to place more bristles in contact with the user's hair during use. In particular, there is a need for a cushion-type brush that orients the bristles towards the user's hair along parallel lines during flexure of the support membrane, rather than concentrating all bristles towards a point of contact as in known cushion brushes.

SUMMARY OF THE INVENTION

The invention relates to a novel brush structure designed to respond to these needs. The invention provides a grooming instrument that can be configured to orient bristles or teeth inwardly toward a contact region along generally parallel lines with relatively little contact force, thus considerably expanding the effective area over which the instrument contacts the hair. In a particularly preferred embodiment described below, the membrane may be biased into a normal or relaxed configuration and transition into a flexed or bent shape through a more or less pronounced "snap" action. Moreover, the invention can be adapted to various shapes and types of grooming instruments, including handled brushes of different head shapes, handled combs and palm-type brushes. In addition, the invention may be incorporated into a variety of similar instruments, including those used for brushing, grooming, massaging and cleansing.

Thus, in accordance with one aspect of the invention, a hair grooming instrument comprises a rigid support having a longitudinal axis and a flexible membrane having first and second ends attached to the rigid support. The flexible membrane comprises a plurality of substantially rigid sections integrally joined along parallel lines of flexure, the parallel lines of flexure being disposed transverse to the longitudinal axis of the rigid support. A plurality of combing elements are secured to and extend from the flexible membrane. The first and second ends of the flexible membrane are pivotally attached to the rigid support. The pivoting action provides the flexible membrane with a consistent transition into the flexed or concave shape even when relatively little contact pressure is applied. The parallel lines of flexure may be regions of reduced thickness formed by parallel grooves in the flexible membrane. A portion of each groove may, if desired, extend through the flexible membrane for facilitating the flow of hot air for blow drying and styling.

In accordance with a particularly preferred aspect of the invention, the flexible membrane has a bow or camber about an axis transverse to the grooves. The bow or camber biases the flexible membrane into a substantially straight configuration and enhances the "snap" action of the flexible membrane.

In addition to the above aspects of the invention, a preferred embodiment of the grooming instrument includes a handle extending in a direction generally parallel to the longitudinal axis. Further, the rigid support includes an aperture therethrough for allowing a decorative insert to be mounted therein or, alternatively, for allowing venting of hot air for blow drying and styling.

In accordance with another aspect of the invention, a brush is provided that includes a head, a flexible support member and a plurality of combing elements. The head has a longitudinal axis, and the flexible support member is flexibly mounted on the head and has a lower surface including a plurality of parallel support sections oriented transverse to the longitudinal axis and a plurality of lines of flexure joining adjacent support sections. The combing elements are supported on the support sections and extend from the lower surface.

In accordance with a further aspect of the invention, a brush includes a substantially rigid base, a flexible support and a plurality of bristles. The flexible support is mounted to the base via first and second pivotal connections, the pivotal connections being configured to permit deformation of the flexible support in the manner of a simple beam. The bristles are secured to and extend from the bristle support. The flexible support preferably extends generally in a plane, with the pivotal connections defining pivotal centers offset from the plane.

Other objects, features, and advantages of the various aspects of the invention will be apparent from the following detailed description when read with the accompanying drawings. These drawings show, by way of example and not limitation, structure for practicing the invention. That is, the drawings are for the purpose of illustration and description only and are not intended as a definition of the limits of the invention.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
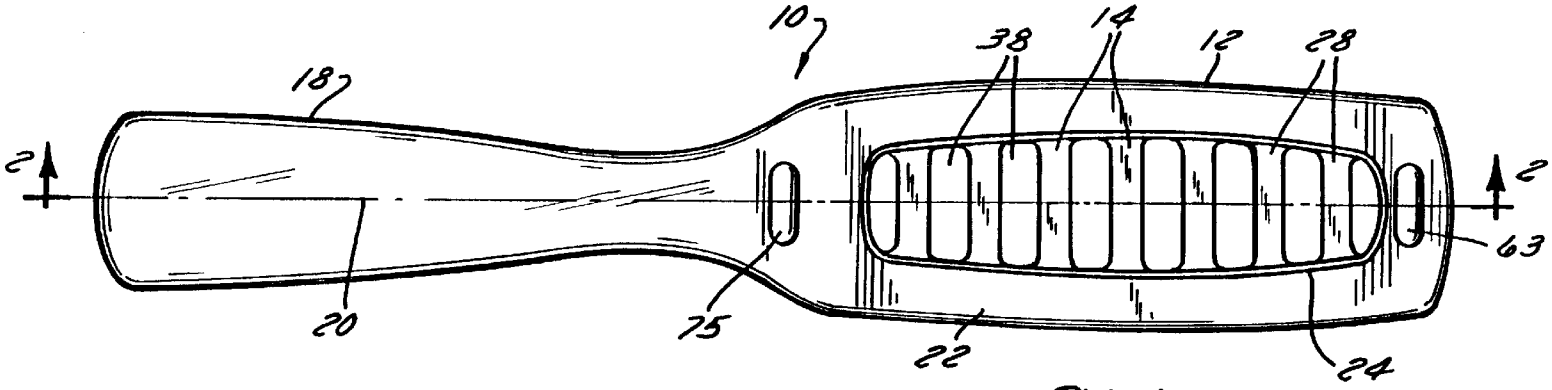
FIG. 1 is a top plan view of a cushion brush incorporating a flexible bristle support.
Figure 2:
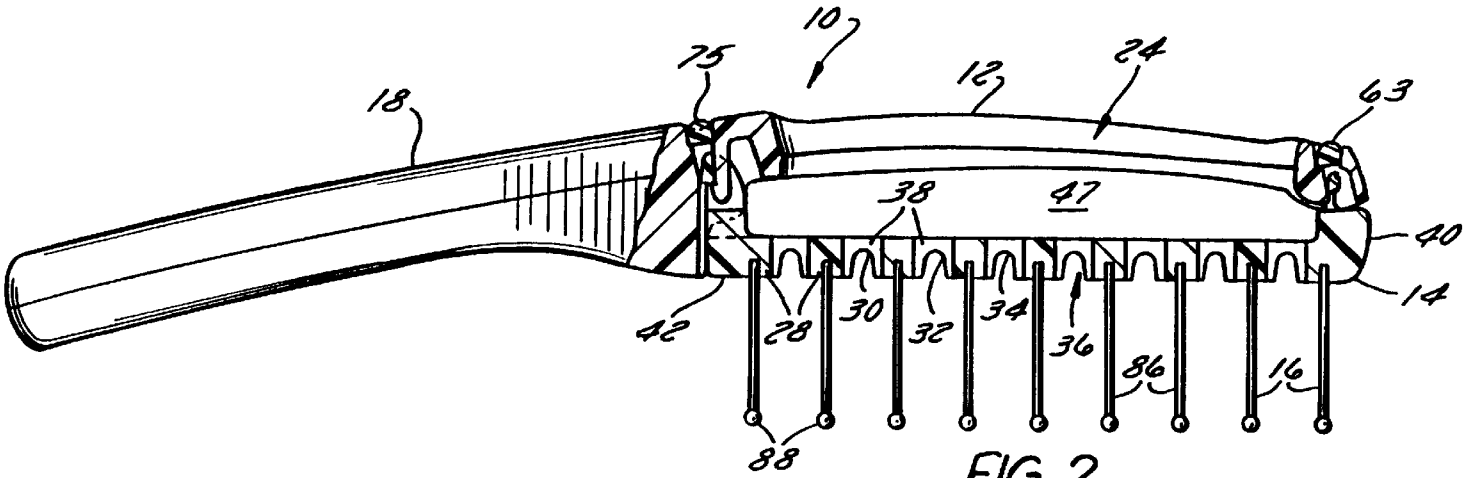
FIG. 2 is a side view of the cushion brush of FIG. 1 taken partially sectioned along line 2—2.

Turning now to the drawings and referring to FIGS. 1 and 2, a hair brush 10 comprises a rigid support 12, a flexible membrane 14 mounted on rigid support 12, and a plurality of combing elements or bristles 16 secured to and extending from flexible membrane 14. In the illustrated embodiment, rigid support 12 includes a conventional elongate handle 18 extending in a direction generally along a longitudinal axis 20 of rigid support 12 and membrane 14. It will be understood, however, that the handle may be omitted when the invention is adapted for other grooming instruments such as a palm-type brush.

Figure 3:
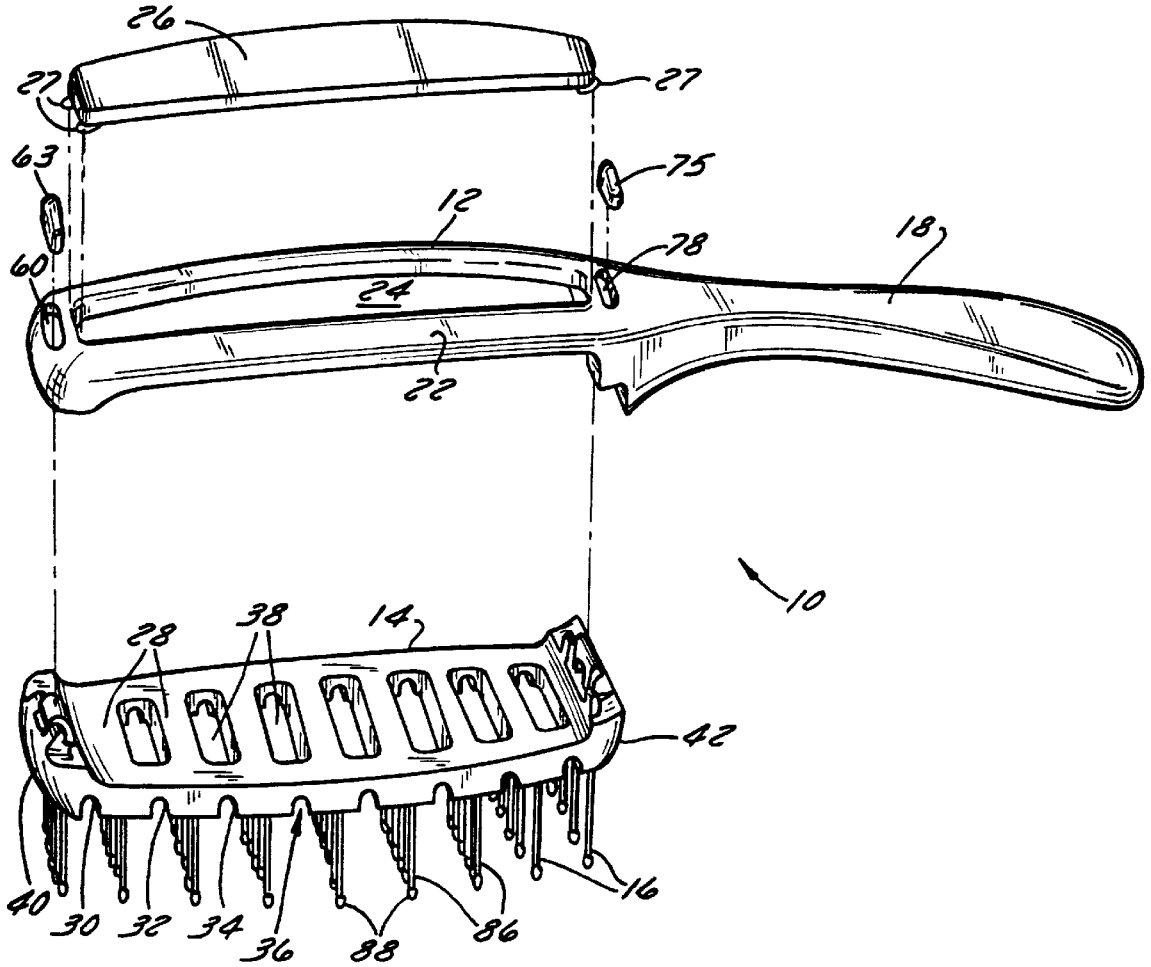
FIG. 3 is an exploded perspective view of the cushion brush of FIG. 1.

As best shown in FIG. 3, rigid support 12 may include a generally planar face 22 and an aperture 24 formed centrally therethrough. A decorative insert 26 may then be mounted or snapped within aperture 24 by appropriate means, such as extensions 27. Alternatively, aperture 24 may provide venting for hot air, such as for blow drying and styling, as in conventional brushes. Preferably, rigid support 12 is constructed from a moldable plastic material.

Flexible membrane 14 comprises a plurality of generally rectangular, parallel, substantially rigid sections 28 connected to one another by flexible regions or webs 30. Flexible webs 30 form a plurality of parallel lines of flexure 32 disposed generally transverse to longitudinal axis 20 of rigid support 12. Preferably, web 30 comprises regions of reduced thickness 34 formed at the base of grooves 36 in flexible membrane 14. In addition, a portion of several or all grooves 36 may, as shown, extend through flexible membrane 14 forming venting apertures 38 for facilitating the flow of air for blow drying and styling. In the preferred embodiment shown, flexible membrane 14 is integrally formed of a moldable plastic material. It will be understood that grooves 36 in flexible membrane 14 may be conveniently formed during the molding operation by means of appropriately positioned protrusions in the mold or, alternatively, subsequent to the molding operation by means of a cutting operation. Moreover, although grooves 36 are shown as being on the same side of membrane 14 as combing elements 16, some or all grooves 36 could be provided or, the side of membrane 14 opposite combing elements 16, or on both sides.

Figure 5:
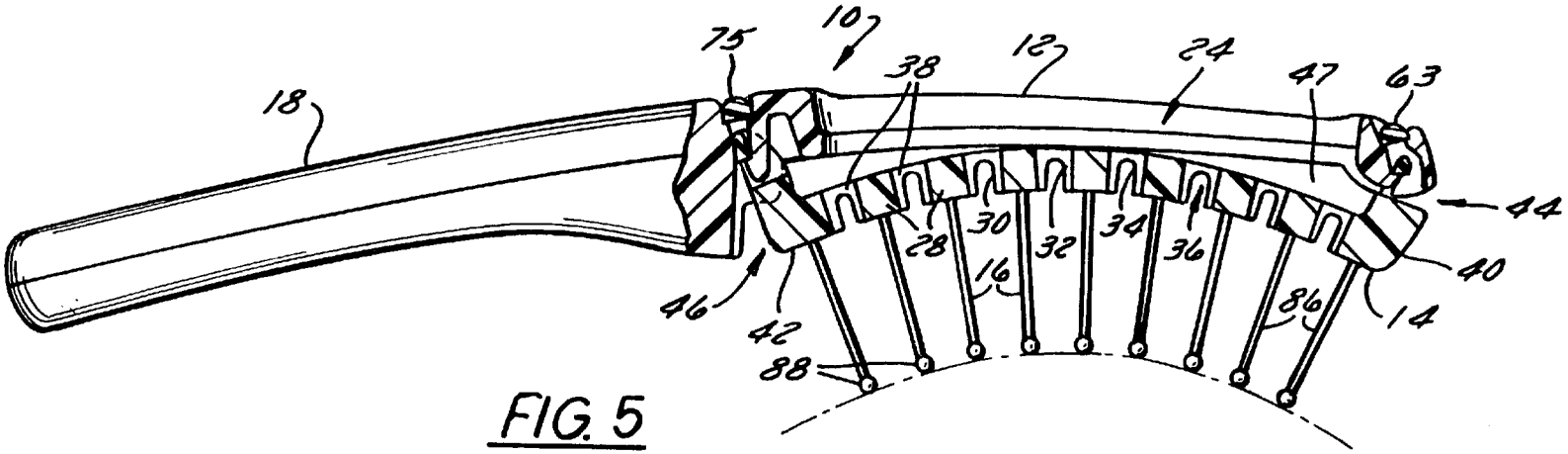
FIG. 5 is a side view of the cushion brush of FIG. 1 partially sectioned along line 2—2 and illustrating the cushion and bristles in the flexed position.

Flexible membrane 14 has first and second ends 40, 42 by which membrane 14 is pivotally attached to rigid support 12 via first and second hinges 44, 46, respectively (see FIG. 5). Pivotal movement of hinges 44, 46 allows flexible membrane 14 to consistently transition into a flexed or concave shape even when relatively little contact pressure is applied. It should be noted that flexible membrane 14 is spaced from rigid support 12 by a gap 47 for allowing membrane 14 to flex to the concave shape during pivotal movement of hinges 44 and 46 as described below.

Preferably, flexible membrane 14 is molded with a slight bow or camber along longitudinal axis 20, causing membrane 14 to "snap" into the straight configuration illustrated in FIGS. 1 and 2. In effect, regions of reduced thickness 34 of web 30 act as leaf springs for biasing flexible membrane 14 into a substantially straight configuration and enhancing the "snap" action of flexible membrane 14 from the curved or bowed configuration described below back into the straight configuration. Moreover, the bias provided by each region of reduced thickness 34 is partially dependent on the thickness of regions 34. Accordingly, in the preferred embodiment, the material of web 30 is slightly thicker near the longitudinal center of flexible membrane 14 than near hinges 44, 46. For example, satisfactory biasing of membrane 14 has been achieved by providing a central web thickness of 40/1000 inches and an end web thickness of 32/1000 inches, with web thicknesses between these locations decreasing linearly. In addition, while regions 34 may have any suitable profile shape, such as semicircular or slightly curved, it has been found that a generally squared trough shape provides a durable support without unnecessarily concentrating stresses in the membrane due to repeated flexure.

Figure 4:
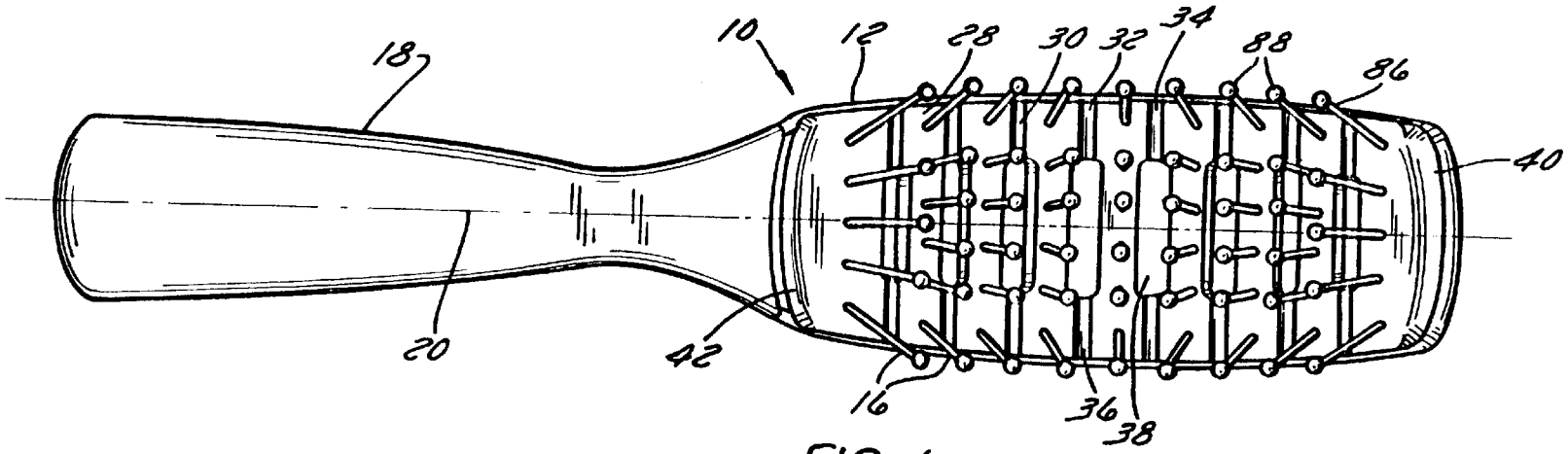
FIG. 4 is a bottom plan view of the cushion brush of FIG. 1 showing the cushion and bristles in the flexed position.

As shown in FIGS. 4 and 5, membrane 14 may be flexed or bowed by contact of combing elements 16 with a point of contact, such as the scalp of a user. As membrane 14 enters into this configuration, regions of reduced thickness 30 flex, causing reorientation of rigid sections 28 along parallel lines and deflecting combing elements 16 into a generally concave arrangement when viewed from the side of brush 10. This flexure places most or all of combing elements 16 in contact with the hair of the user. Moreover, unlike conventional cushion brushes, which tend to concentrate or orient bristles toward a point of contact, as illustrated in the FIGURES, the present arrangement permits bristles supported on each rigid section 28 to remain spaced from one another, while converging parallel rows of combing elements toward the user's hair.

Before describing the preferred embodiments of hinges 44, 46 in detail, it is noted that hinges 44, 46 may be of any design suitable for providing an attachment allowing free pivoting in either of two opposite directions about an axis transverse to longitudinal axis 20, while resisting pivoting about an axis along longitudinal axis 20.

Figure 6:
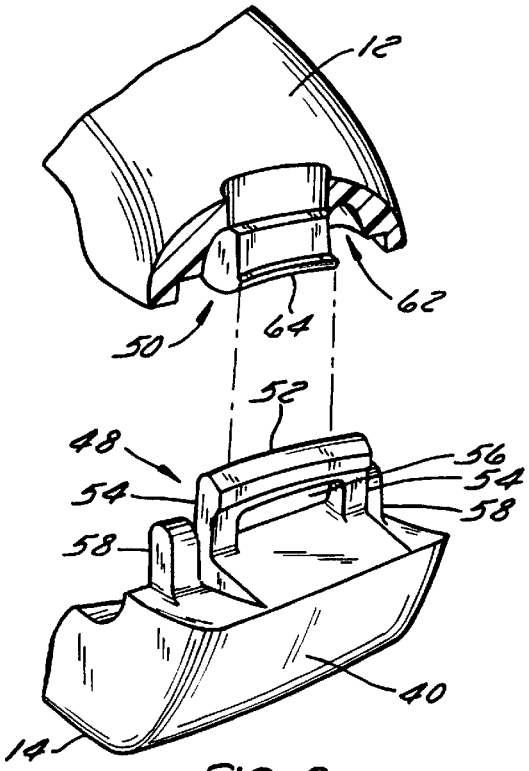
FIG. 6 is a fragmentary perspective view depicting a hinge of one end of the cushion brush of FIG. 1.

Referring now to FIG. 6, a preferred embodiment of first hinge 44 (i.e., the distal hinge in relation to handle 18) is shown comprising a slotted portion 48 integrally formed on first end 40 of flexible membrane 14 and a barbed portion 50 integrally formed on rigid support 12. Slotted portion 48 comprises a cam 52 spaced above first end 40 of membrane 14 by a pair of laterally spaced, flexible suspension members 54, forming a horizontal slot 56 between cam 52 and membrane 14. In addition, slotted portion 48 includes a pair of upstanding bearing members 58 positioned laterally offset from respective suspension members 54. Barbed portion 50 of hinge 44 comprises a central aperture 60 configured for housing cam 52, a pair of bearing notches 62 (only one of which is shown exposed in FIG. 6) configured for receiving bearing members 58, and a barb 64 projecting horizontally into aperture 60 for engaging slot 56. Central aperture 60 extends completely through rigid support 12 and is large enough to allow cam 52 to pivot freely therewithin and to be accessed for removing flexible membrane 14 from rigid support 12. A plug 63 is used to close off the upper end of aperture 60. Bearing notches 62 are shallower than the height of bearing members 58 and wider than the width of bearing members 58.

Figure 7:
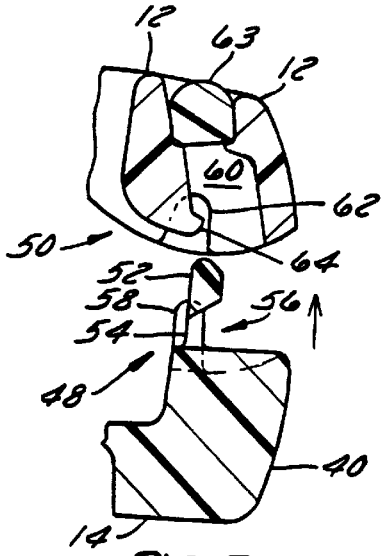
FIG. 7 is a side sectional detail view of the hinge of FIG. 6 prior to assembly.
Figure 8:
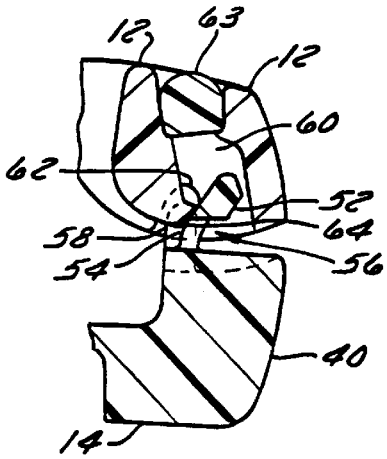
FIG. 8 is a side sectional detail view of the hinge of FIG. 6 during assembly.
Figure 9:
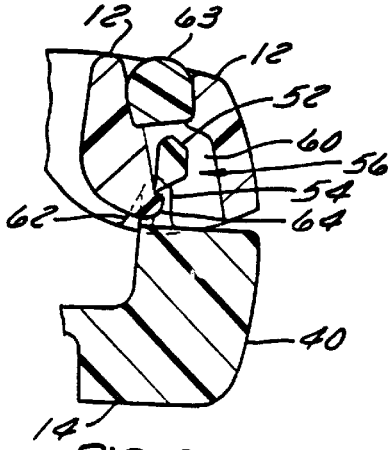
FIG. 9 is a side sectional detail view of the hinge of FIG. 6 after assembly.

Assembly of first hinge 44 is carried out as follows. As shown in FIG. 7 slotted portion 48 and barbed portion 50 are placed in mutually facing relation. Subsequently, flexible membrane 14 is partially engaged with rigid support 12 as shown in FIG. 8, and suspension members 54 are pressed into a flexed position by barb 64 engaging cam 52, allowing further engagement to take place. As illustrated in FIG. 9, assembly is completed by further engaging membrane 14 on support 12 until barb 64 extends into slot 56 and suspension members 54 are allowed to move in their relaxed position. With this arrangement, flexible membrane 14 is pivotally locked to rigid support 12 at hinge 44 by means of tensioned suspension members 54 in opposition with compressed bearing members 58.

Figure 10:
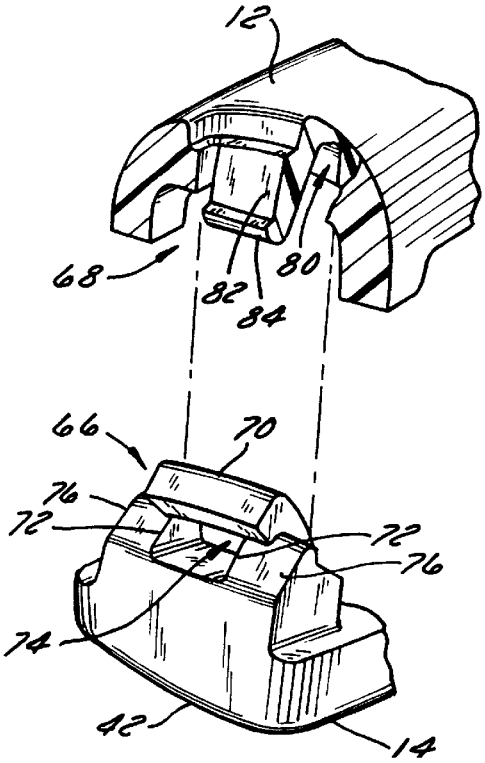
FIG. 10 is a perspective view depicting a hinge on a second end of the cushion brush of FIG. 1.

Referring now to FIG. 10, a preferred embodiment of second hinge 46 (i.e., the proximal hinge in relation to handle 18) is shown comprising a slotted portion 66 integrally formed on second end 42 of flexible membrane 14 and a barbed portion 68 integrally formed on rigid support 12. Slotted portion 66 comprises a cam 70 spaced from second end 42 of membrane 14 by a pair of laterally spaced suspension members 72, forming a slot 74 between cam 70 and membrane 14. In addition, suspension members 72 extend laterally beyond the portion necessary to support cam 70, thereby forming adjacent bearing portions 76. The barbed portion 68 of hinge 46 comprises a central aperture 78 configured for housing cam 70, a pair of bearing notches 80 (only one of which is shown exposed in FIG. 10) configured for receiving bearing portions 76, and a downwardly depending, flexible tongue 82 having a barb 84 projecting horizontally into aperture 78 for engaging slot 74. Central aperture 78 extends completely through rigid support 12 and is large enough to allow cam 70 to pivot freely therewithin and to be accessed for removing flexible membrane 14 from rigid support 12. A plug 75 is used to close off the upper end of aperture 60.

Figure 11:
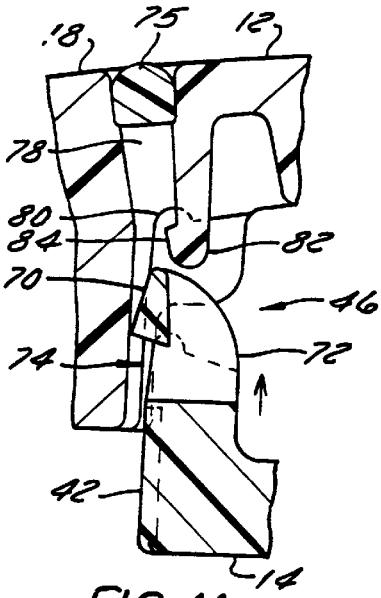
FIG. 11 is a side sectional detail view of the hinge of FIG. 10 prior to assembly.
Figure 12:
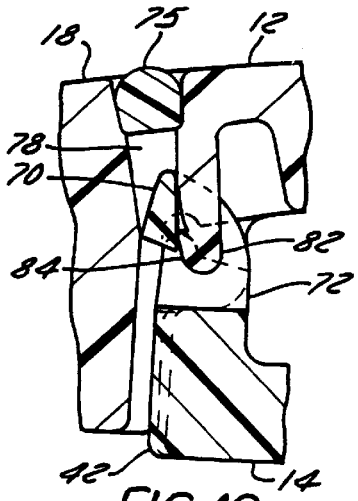
FIG. 12 is a side sectional detail view of the hinge of FIG. 10 during assembly.
Figure 13:
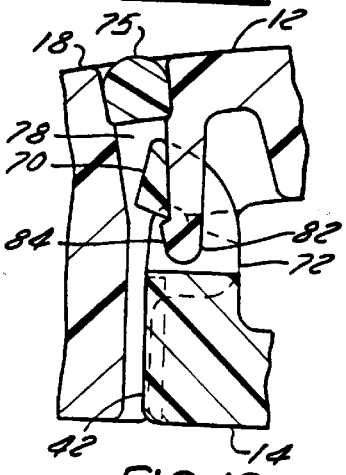
FIG. 13 is a side sectional detail view of the hinge of FIG. 10 after assembly.

Assembly of hinge 46 proceeds as follows. As shown in FIG. 11, the hinge elements are positioned in mutually facing relation prior to assembly. From this position, flexible membrane 14 is partially engaged with rigid support 12 as shown in FIG. 12, with tongue 82 pressed into a flexed position by barb 84 engaging cam 70, allowing further engagement to take place. As shown in FIG. 13, assembly is then completed with barb 84 extending into slot 74 and tongue 82 back in its relaxed position. With this arrangement, flexible membrane 14 is pivotally locked to rigid support 12 at hinge 46 by means of tensioned suspension members 72 in opposition with compressed bearing portions 76.

The plurality of combing elements 16 comprise a plurality of bristle bunches or stiff teeth 86 projecting from flexible membrane 14. In the illustrated embodiment, teeth 86 comprise monofilament, epoxy tipped bristles. It will be understood, however, that other suitable bristle types known in the industry may be used so long as the bristles or teeth are sufficiently stiff that membrane 14 transitions to the flexed shape during normal use. As best shown in FIG. 4, teeth 86 may be arranged in rows parallel to parallel lines of flexure 32 of web 30, with each rigid section 28 of membrane 14 supporting at least one row of teeth 86. That is, teeth 86 project generally upwardly from a first plane defined by the upper crests of rigid sections 28 when brush 10 is not in use.

Figure 14:
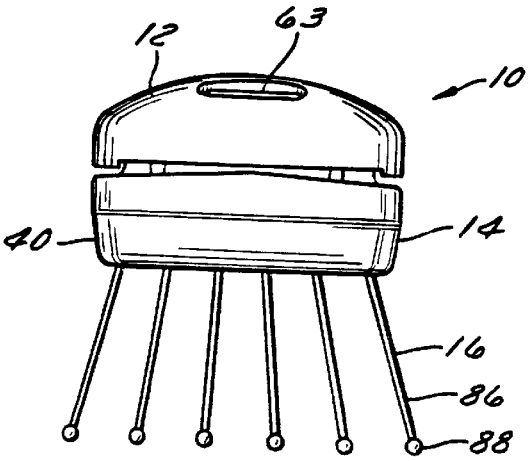
FIG. 14 is an end view of the brush of FIG. 1.

Referring now to FIG. 14, teeth 86 situated along each row are preferably directed outwardly from longitudinal axis 20 (i.e., diverging away from the center of each row), the degree of divergence being greater as the teeth are located farther from longitudinal axis 20. For example, teeth closest to longitudinal axis 20 may be inclined at an angle of several 3 degrees outward with respect to a plane traversing brush 10 along axis 20, while teeth farthest from longitudinal axis 20 may be inclined at an angle of 10 to 15 degrees or more with respect to the plane. Moreover, in the preferred embodiment illustrated, teeth 86 are clipped, cut or preformed to terminate in a common plane (containing tips 88) when membrane 14 is in the relaxed or normal position. Thus, when membrane 14 is flexed as teeth 86 are brought into contact with the hair or scalp, teeth 86 are reoriented into contact with the hair in a generally curved plane.

It should be noted from the foregoing that membrane 14 is preferably generally supported in the manner of a simple beam which may be freely pivoted at either end. Thus, the attachment points defined by the hinge structures at either end of membrane 14 permit deflection of membrane 14 substantially along its entire length. Moreover, it should be noted that in the preferred embodiment described above, the bearing surfaces that define the center of pivotal movement of the ends of membrane 14 are offset from the plane of membrane 14, permitting membrane 14 to deform readily and allowing the length of membrane 14 effectively to change (i.e. shorten) as membrane 14 is bowed.

As will be understood from the foregoing, in use, brush 10 is normally stroked across a user's head in a direction of movement transverse to longitudinal axis 20. Contact of teeth 86 with the a surface of sufficient rigidity will cause hinges 44, 46 to pivot and flexible membrane 14 to flex inwardly, bringing a substantial number of the parallel rows of teeth 86 into conforming contact with the user's head. Of course, while the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims. For example, rather than forming the parallel lines of flexure in the flexible membrane by means of regions of reduced thickness, the lines of flexure could be formed by use of material having greater flexibility than the substantially rigid sections. Similarly, the hinge structures described above may be modified in various manners, such as to facilitate manufacture or assembly. For example, one or both hinges may be formed as a living hinge or region of reduced thickness. Also, teeth 86 may be molded integrally with membrane 14 or added in an assembly process subsequent to formation of membrane 14.

We claim:

1. A hair grooming instrument, comprising:

a rigid support having a longitudinal axis;

a flexible membrane having first and second longitudinally opposed ends pivotally and removably attached to the rigid support, the flexible membrane comprising a plurality of substantially rigid sections integrally joined along parallel lines of flexure, the parallel lines of flexure being disposed transverse to the longitudinal axis of the rigid support; and a plurality of combing elements secured to and extending from the flexible membrane.

2. The hair grooming instrument of claim 1, further comprising a handle extending from the rigid support in a direction generally parallel to the longitudinal axis.

3. The hair grooming instrument of claim 1, wherein the rigid support includes a generally planar face and wherein an aperture is formed through the planar face.

4. The hair grooming instrument of claim 1, wherein the rigid support is constructed from a moldable plastic material.

5. The hair grooming instrument of claim 1, wherein the parallel lines of flexure are grooves formed in the flexible membrane.

6. The hair grooming instrument of claim 5, wherein a portion of each groove extends through the flexible membrane.

7. The hair grooming instrument of claim 1, wherein the first and second ends of the flexible membrane are pivotally attached to the rigid support by first and second hinges, respectively.

8. The hair grooming instrument of claim 7, wherein at least one of the hinges comprises a barb formed on the rigid support engaged with a slot formed in the flexible membrane.

9. The hair grooming instrument of claim 1, wherein the flexible membrane is constructed from a moldable plastic material.

10. The hair grooming instrument of claim 1, wherein the plurality of combing elements is a plurality of bristle bunches.

11. The hair grooming instrument of claim 1, wherein the plurality of combing elements is arranged in rows disposed parallel to the parallel lines of flexure.

12. The hair grooming instrument of claim 1, wherein each substantially rigid section supports at least one of the plurality of combing elements.

13. A brush comprising:

a head having a longitudinal axis and a generally planar face, the planar face including an aperture;

a decorative insert removably mounted in the aperture;

a flexible support member mounted on the head via first and second longitudinally opposed pivotal connections, the flexible support member having a lower surface having a plurality of parallel support sections oriented transverse to the longitudinal axis and a plurality of parallel lines of flexure joining adjacent support sections; and a plurality of combing elements supported on the support sections and extending from the lower surface.

14. The brush of claim 13, wherein the plurality of parallel lines of flexure are grooves formed in the lower surface.

15. The brush of claim 14, wherein a portion of each groove extends through the flexible support member.

16. The brush of claim 13, wherein the plurality of combing elements is arranged as a plurality of rows disposed parallel to the lines of flexure.

17. The brush of claim 13, wherein each support section secures at least one of the plurality of combing elements.

18. The brush of claim 17, wherein the combing elements are stiff teeth.

19. The hair grooming instrument of claim 13, wherein the first and second pivotal connections are hinges.

20. The brush of claim 19, wherein the hinges are grooved lines of flexure.

21. A hair grooming instrument, comprising:

a substantially rigid base;

a flexible bristle support mounted to the base via first and second pivotal connections, the bristle support having a plurality of substantially parallel sections and regions of reduced thickness disposed between adjacent parallel sections, the regions of reduced thickness permitting flexure of the bristle support between adjacent parallel sections, the bristle support having a central portion spaced from the rigid base by a gap, the gap permitting flexure of the central portion toward the rigid base; and a plurality of bristles secured to and extending from the bristle support.

22. The brush of claim 21, wherein the regions of reduced thickness include parallel grooves extending across the flexible bristle support.

23. The brush of claim 21, wherein the flexible bristle support has a bow or camber about an axis transverse to the regions of reduced thickness, the bow or camber biasing the flexible bristle support into a substantially straight configuration.

24. The brush of claim 21, wherein the flexible bristle support includes venting apertures extending therethrough.

25. The brush of claim 21, wherein the bristles are arranged in rows disposed parallel to the parallel sections.

26. The brush of claim 21, wherein each parallel section includes one of the rows of bristles.

27. The brush of claim 21, wherein the bristles are stiff teeth.

28. The brush of claim 21, further comprising a handle extending from the base.

29. A brush comprising:

a substantially rigid base having a longitudinal axis;

a flexible support mounted to the base via first and second pivotal connections, the pivotal connections being configured to permit deformation of the flexible support in the manner of a simple beam and to permit the flexible support to be removed from the base, the flexible support including at least one line of flexure disposed transverse to the longitudinal axis of the rigid base; and a plurality of bristles secured to and extending from the flexible support.

30. The brush of claim 29, wherein the flexible support includes a plurality of substantially parallel sections and regions of reduced thickness disposed between adjacent parallel sections, the regions of reduced thickness permitting flexure of the flexible support between adjacent parallel sections.

31. A brush comprising:

a substantially rigid base;

a flexible support mounted to the base via first and second pivotal connections, wherein the flexible support extends generally in a flat plane when in a relaxed position and the pivotal connections define pivotal centers offset from the plane to permit deformation of the flexible support in the manner of a simple beam substantially along an entire length of the flexible support; and a plurality of bristles secured to and extending from the flexible support.

* * * * *